United States Patent [19]

Machado

[11] Patent Number: 4,930,653

[45] Date of Patent: Jun. 5, 1990

[54] REFUSE CONTAINER CADDY APPARATUS

[76] Inventor: Daniel Machado, 2767 Canterbury, Northbrook, Ill. 60062

[21] Appl. No.: 383,597

[22] Filed: Jul. 24, 1989

[51] Int. Cl.[5] ..... B65D 21/02

[52] U.S. Cl. ..... 220/23.4; 220/17; 220/69; 220/32.83

[58] Field of Search ..... 220/17, 23.4, 69, 23.83

[56] References Cited

U.S. PATENT DOCUMENTS

| | | | |
|---|---|---|---|
| 1,213,588 | 1/1917 | Cohen | 220/17 |
| 2,495,505 | 1/1950 | Bella | 220/17 |
| 3,306,486 | 2/1967 | Martino et al. . | |
| 3,342,368 | 9/1967 | Matry | 220/17 |
| 3,812,995 | 5/1974 | Lewis | 220/69 |
| 3,927,786 | 12/1975 | Aboud | 220/17 |
| 3,997,072 | 12/1976 | Guth | 220/17 |
| 4,151,910 | 5/1979 | Yasur | 220/69 |
| 4,167,271 | 9/1979 | Jorgensen . | |
| 4,363,417 | 12/1982 | Rhoades et al. . | |
| 4,558,796 | 12/1985 | Jaicks . | |
| 4,666,054 | 5/1987 | Jaicks . | |
| 4,702,385 | 10/1987 | Shillington et al. | 220/17 |

*Primary Examiner*—Joseph Man Fu Moy
*Attorney, Agent, or Firm*—Leon Gilden

[57] ABSTRACT

A refuse container caddy apparatus is set forth wherein an overlying support tray removably secures a plurality of polygonal refuse containers wherein an underlying second support tray releasably secures a plurality of circular cross-sectional refuse containers. The overlying refuse containers are secured utilizing opposed pivoted latch members wherein the underlying second support tray utilizes an upwardly extending "T" shaped connector cooperative with a securement plate positioned within a cavity of the circular cross-sectional containers.

10 Claims, 3 Drawing Sheets

REFUSE CONTAINER CADDY APPARATUS

BACKGROUND OF THE INVENTION

1. Field of the Invention

The field of invention relates to refuse containers, and more particularly pertains to a new and improved refuse container caddy apparatus wherein the same selectively secures polygonal and circular cross-sectional refuse containers thereto.

2. Description of the Prior Art

The use of refuse containers and the like is well known in the prior art. The prior art has heretofore failed to set forth an apparatus that may be selectively employed to secure polygonal and circular cross-sectional refuse containers within a single apparatus. The prior art has utilized refuse containers of unique configurations for particular applications, wherein the instant invention surmounts the shortcomings of the prior art to provide a multi-purpose support organization for securement of various refuse containers thereto. The prior art is exemplified by U.S. Pat. No. 3,306,486 to Martino wherein a waste receptacle of generally polygonal cross-sectional configuration provided with recesses at opposed sides thereof for securement of a spring-biased "U" shaped latch member thereto to secure the receptacle to a pre-selected base. The Martino patent is of interest relative to the general organization of a polygonal refuse container securable &o a support base.

U.S. Pat. No. 4,666,054 to Jaicks sets forth a storage container provided with recesses at lowermost ends of the side wall thereof wherein an individual may position a foot to secure the container upon removal of a sealable lid secured thereto.

U.S. Pat. No. 4,167,271 to Jorgensen sets forth a refuse holder with an interlockable latch member at a lowermost wall for securement to a support base. The wall includes a bifurcated fork securable to a "T" shaped latch of the base portion.

U.S. Pat. No. 4,363,417 to Rhoades sets forth a refuse container provided with a recess at a lowermost forward wall thereof to enable securement by a foot of a user upon removal of the lid portion of the trash can, as is typical of this class of refuse container.

U.S. Pat. No. 4,558,796 to Jaicks sets forth a storage container provided with an outwardly extending flange member whereupon a user may secure the container with his feet while removing or securing the lid to the container.

As such, it may be appreciated there is a continuing need for a new and improved refuse container caddy apparatus wherein the same addresses both the problems of effectiveness and versatility in use, and in this respect, the present invention substantially fulfills this need.

SUMMARY OF THE INVENTION

In view of the foregoing disadvantages inherent in the known types of refuse container caddy apparatus now present in the prior art, the present invention provides a refuse container caddy apparatus wherein the same may selectively have securable thereto a first pair of refuse containers securable at lowermost edges thereof by spring-biased clips with a second plurality of refuse containers securable by means of underlYing "T" bar connector. As such, the general purpose of the present invention, which will be described subsequently in greater detail, is to provide a new and improved refuse container caddy apparatus which has all the advantages of the prior art refuse containers and none of the disadvantages.

To attain this, the present invention comprises a refuse container caddy apparatus including a first support tray securable to an underlying second support tray by means of interlocking tongue and groove organization. The first support tray is provided with a plurality of spring-biased latches to secure lowermost steps against the floor of the first support tray. The second support tray has securable thereto a plurality of upwardly extending "T" shaped connectors interengageable within mounting members secured within an interior axial cavity of the second refuse containers formed of a circular cross-sectional configuration.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, me&hods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refuse container caddy apparatus which has all the advantages of the prior art refuse container caddy apparatus and none of the disadvantages.

It is another object of the present invention to provide a new and improved refuse container caddy apparatus which may be easily and efficiently manufactured and marketed.

It is a further object of the present invention to provide a new and improved refuse container caddy apparatus which is of a durable and reliable construction.

An even further object of the present invention is to provide a new and improved refuse container caddy apparatus which is susceptible of a low cost of manufacture with regard to both materials and labor, and which accordingly is then susceptible of low prices of sale to the consuming public, thereby making such refuse container caddy apparatus economically available to the buying public.

Still yet another object of the present invention is to provide a new and improved refuse container caddY apparatus which provides in the apparatuses and methods of the prior art some of the advantages thereof, while simultaneously overcoming some of the disadvantages normally associated therewith.

Still another object of the present invention is to provide a new and improved refuse container caddy apparatus wherein the same has a plurality of selectively securable first and second support tray organizations to secure first and second pairs of refuse containers.

These together with other objects of the invention, along with the various features of novelty which characterize the invention, are pointed out with particularity in the claims annexed to and forming a part of this disclosure. For a better understanding of &he invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to &he following detailed description thereof. Such description makes reference to the annexed drawings wherein.

DESCRIPTION OF THE PREFERRED EMBODIMENT

Figure 1:
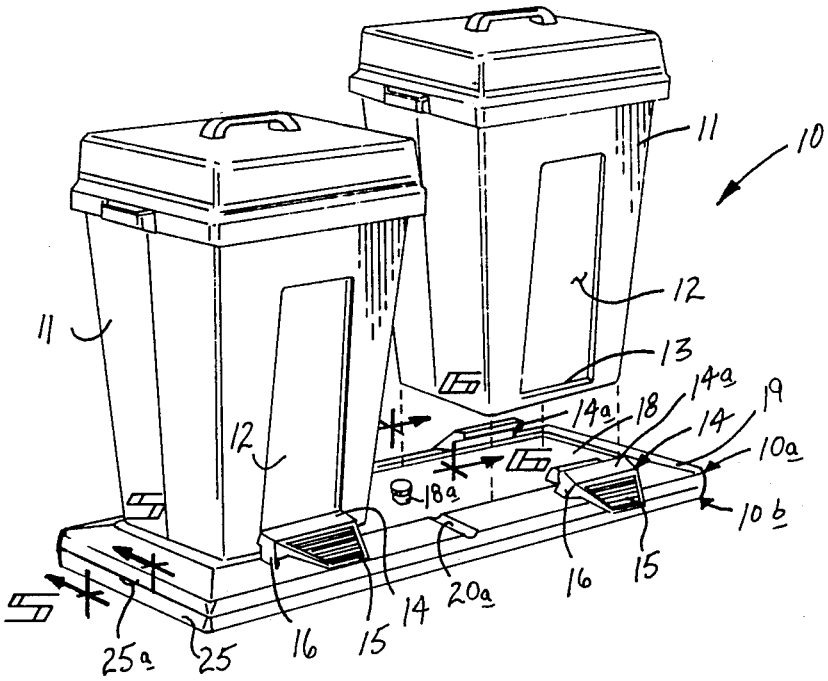
FIG. 1 is an isometric illustration of the instant invention having secured thereto the first pair of polygonal refuse containers.
Figure 2:
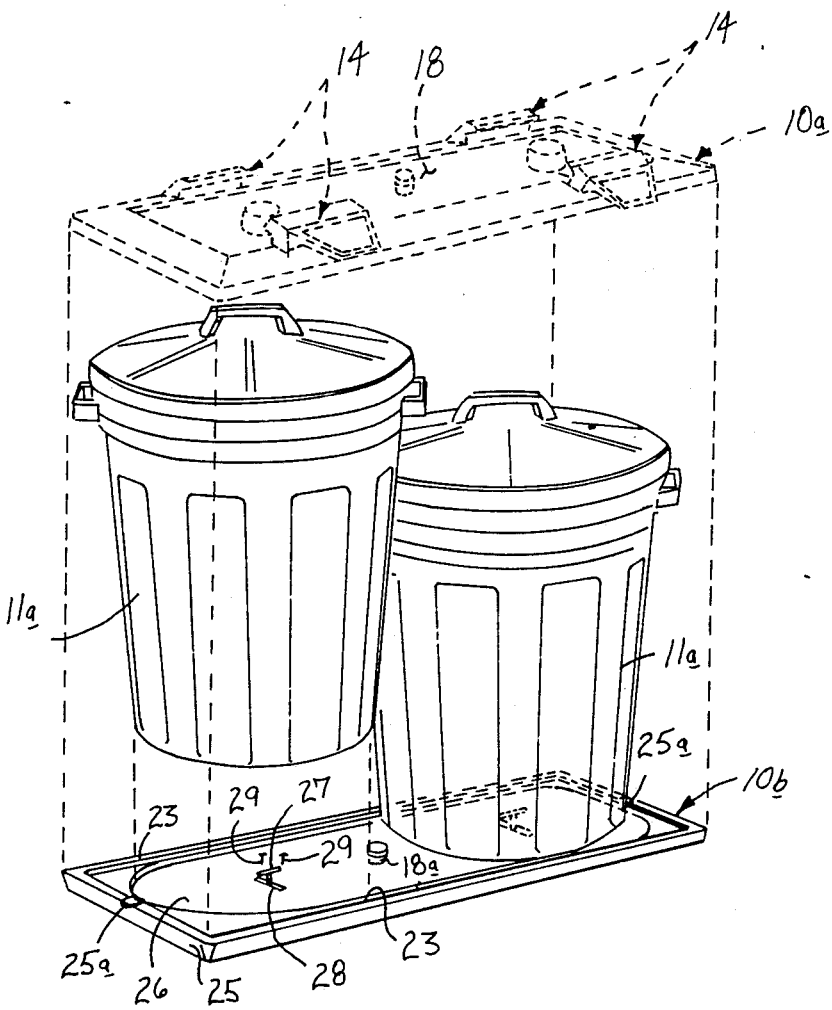
FIG. 2 is an isometric illustration having secured thereto the second plurality of refuse containers to the second support tray.
Figure 3:
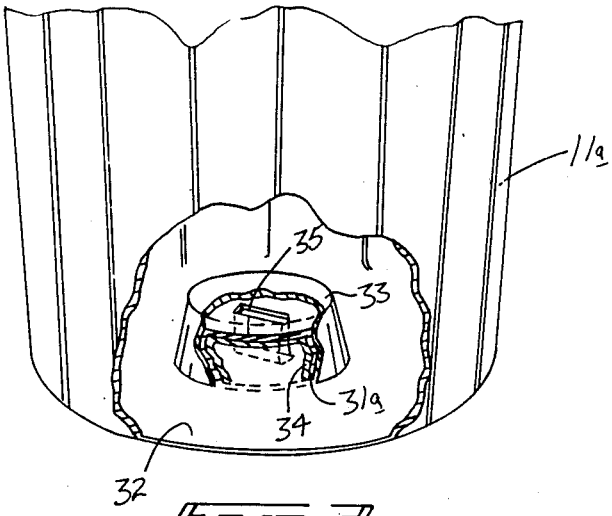
FIG. 3 is an isometric illustration, partially in section, of the detail of the fastening members within the lowermost portion of the second refuse container pair.

With reference now to the drawings, and in particular to FIGS. 1 to 6 thereof, a new and improved refuse container caddy apparatus embodying the principles and concepts of the present invention and generally designated by &he reference numeral 10 will be described.

More specifically, the refuse container caddy apparatus 10 of the instant invention essentiallY comprises a tapered polygonal first refuse container pair 11 formed with elongate longitudinal downwardly tapering recesses 12 terminating in horizontal steps 13 at opposed sides of the respective first refuse containers 11. The horizontal steps 13 are registrable with opposed pairs of latches 14. The latches 14 include a forward latch flange 14*a* overlying the respective horizontal step of the first refuse containers 11 when the refuse containers are positioned on the first support tray 10*a*. A rearwardly extending serrated treadle 15 extends rearwardly of the forward latch flange 14*a* of each latch 14 with a spring 15*a* fixedly positioned between the underlying surface of the treadle 15 and the upper surface of the downwardly tapering rear wall 20 of the first support tray 10*a*. Each latch 14 further includes a plurality of downwardly extending vertically oriented legs 16 secured and connected thereto by a securement web 17 mounted within the upper surface of the rear wall 20 to fixedly mount each respective latch 14 within the first support tray 1O*a*.

The first support tray 10*a* includes a recessed planar support floor 18 with an upwardlY extending surrounding first ridge 19 merging into the rearwardly extending downwardly tapering rear wall 20. A first drain channel 20*a* is orthogonally positioned through the first ridge 19 and the rear wall 20 to enable drainage of fluid captured within the floor 18.

Figure 5:
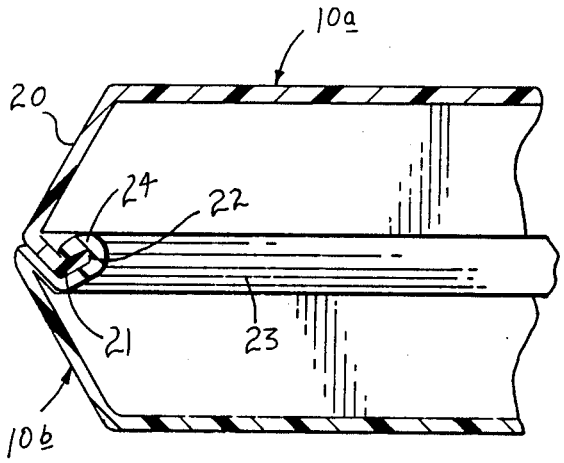
FIG. 5 is an orthographic cross-sectional view taken along the lines 5—5 of FIG. 1 in the direction indicated by the arrows.
Figure 6:
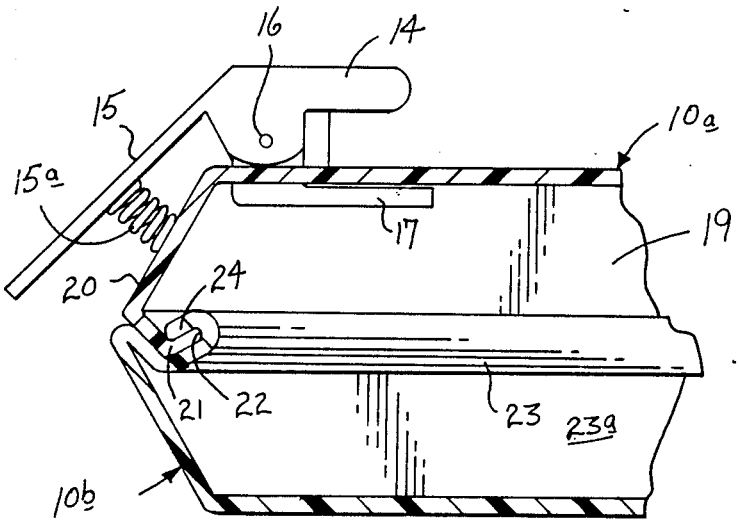
FIG. 6 is an orthographic cross-sectional view taken along the lines 6—6 of FIG. 1 in the direction indicated by the arrows.

Reference to FIG. 5 illustrates the rear wall 20 formed with an orthogonally and inwardly directed "L" shaped tongue 21 with the upper leg of the "L" shaped tongue directed upwardly and receivable within an elongate perimeter groove formed within the outer wall of the second support tray 1O*b*. The "L" shaped tongue 21 is selectively securable and removable relative to the elongate perimeter groove 22 to selectively secure the first support tray to the second support tray, as desired. The perimeter groove is formed within a surrounding second ridge 23 of the second support tray 10*b* including an overlying lip 24 to form a complementary configuration to the "L" shaped tongue 21 of the first support tray 10*a*. Further, this complementary relationship provides a waterproof sealing relationship between the two support trays preventing moisture from entering the second support tray 10*b* when secured to the first support tray 10*a*. A second drainage channel 25*a* is formed orthogonally through the surrounding wall 25 of the second support tray 1O*b* to define a second planar surface 26 therewithin. A drain plug and removable cap 18*a* is mounted through the floor 18 to enable chamber 23*a* within the second support tray and the base chamber underlying floor 26 to be selectively filled with fluid for weight and stability of the organization. Fluid mixtures ethyl slycol may be utilized during periods of termperatures below freezing.

A plurality of spaced "T" shaped lock members are securable to the second planar support surface 26 by a plurality of connector members 29 extending through lock member flanges 28. When the first support tray 10*a* is removed from the second support tray 10*b*, the "T" shaped lock members 27 defined as upwardly extending "T" shaped portions orthogonally secured to the support surface 26 are readily fastened thereto.

Figure 4:
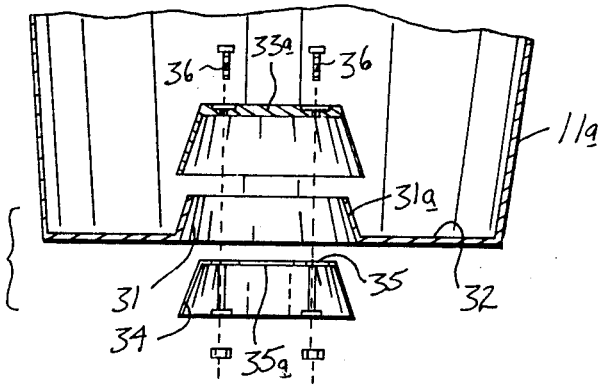
FIG. 4 is a cross-sectional view of the second refuse containers illustrated in FIG. 3, somewhat exploded, to illustrate the various parts, their configuration, and relationship.
Figure 4A:
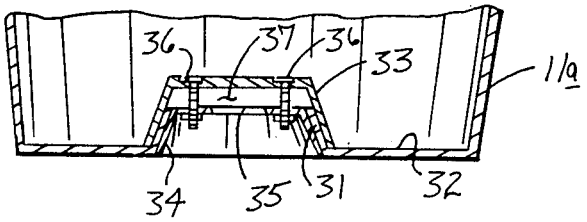
FIG. 4*a* illustrates the fastener members in registration with the second refuse container.

A second pair of circular cross-sectional second refuse containers 11*a* are thereby securable to the support surface 26 wherein each second refuse container 11*a* includes an axially aligned central cavity 31 formed with upwardly extending truncated conical walls 31*a* formed within the floor 32 of the second refuse containers 11*a*. An overlying truncated conical fastener member 33 overlies the conical wall 31*a* with an underlying truncated conical fastener member 34 positioned within the interior of the conical wall 31*a*. The underlying truncated conical wall 34 is formed with a slot 35*a* formed within an upper wall of the underlYing fastener member 34 with a plurality of fasteners 36 extending and received within recesses of an upper wall 33*a* of the overlying fastener member 88 to secure the overlying and underlying fastener members 33 and 34 together respectively, as illustrated in FIG. 4*a*. A space 87 is thereby defined between the overlying and underlying fasteners 33 and 34 to thereby enable the "T" shaped lock member 27 to be extended through the slot 35*a* and received within the space 37 and upon rotation of the second refuse container 11*a* with respect to the "T" shaped lock member 27, the "T" shaped lock member will be directed onto the upper wall 35 of the underlying fastener member 34. Removal of the second refuse container 11*a* merely requires rotation of the second refuse container 11*a* relative to the "T" shaped lock member 27 until the "T" shaped lock members align with the slot 35*a* and thereby enables the refuse container 11*a* to be withdrawn from the second support tray 10*b*. It is further understood that the "T" shaped lock member 27 is provided with the upper legs of the "T" of a length receivable within the slot 35*a* wherein the slot 35*a* is axially aligned with the "T" shaped lock members 27, &he underlying conical fastener 34, the overlying conical fastener 33, and the truncated conical wall 31*a*, which is in itself axially aligned with the respective second refuse container 11*a*.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A refuse container caddy apparatus comprising, in combination, at least one first refuse container of polygonal cross-sectional configuration, and a first support tray formed with a first recess floor dimensioned to receive the first refuse container, and a surrounding first wall formed about the first floor, and a plurality of opposed latch means pivotally mounted within the first wall on opposite sides of the first floor for selective registration with opposed horizontal steps formed within opposed side walls of the first refuse container, and a second support tray selectively securable to the first securement tray, and first securement means formed about the perimeter of the first support tray for selective securement to a second securement means formed about the perimeter of the second support tray to enable selective securement of the first support tray in overlying relationship to the second support tray

2. A refuse container caddy apparatus as set forth in claim 1 wherein said first support tray includes a first ridge extending upwardly of said first recessed floor including a downwardly extending rear wall extending rearwardly of said first ridge, and said rear wall including a drainage channel formed therethrough to enable drainage from the first floor through the first ridge and associated rear wall.

3. A refuse container caddy apparatus as set forth in claim 2 wherein said latching means includes a forwardly extending latch flange and a rearwardly extending serrated treadle with downwardly extending legs formed to each side of the latch flange and treadle with a web connecting the lowermost terminal edges of the legs interiorly of the rear wall to pivotally mount the latch means relative to the rear wall, and a spring positioned between the treadle and rear wall to bias the latch means in association with the horizontal steps of the first refuse container.

4. A refuse container caddy apparatus as set forth in claim 3 wherein the first securement means includes an "L" shaped tongue directed inwardly of the rear wall cooperating with a groove formed within the second securement means.

5. A refuse container caddy apparatus as set forth in claim 4 wherein the groove is of a complementary configuration to the "L" shaped tongue of the first securement means.

6. A refuse container caddy apparatus as set forth in claim 5 wherein a second support tray includes a recessed support surface for receiving at least a second refuse container of circular cross-section.

7. A refuse container caddy apparatus as set forth in claim 6 wherein said recessed support surface further includes at least one upwardly extending "T" shaped lock member selectively securable to said recess support surface and further including a lock member flange secured to the base of the "T" shaped lock member to enable selective securement of &he lock member flange and "T" shaped lock member to the recess support surface.

8. A refuse container caddy apparatus as set forth in claim 7 wherein the second refuse container includes an axially aligned truncated conical wall extending upwardly of a floor of the second refuse container, and an overlying truncated conical fastening member positionable overlying the truncated wall, and an underlying truncated conical fastener member positionable underlying the truncated conical wall, and the underlying truncated conical fastener member including an upper wall, and the overlying truncated conical member including a further upper wall, with a spaced defined between the further upper wall and upper wall when the overlying truncated conical fastener member is secured to the underlying truncated conical fastener member sandwiching the truncated conical wall therebetween.

9. A refuse container caddy apparatus as set forth in claim 8 wherein the upper wall includes a slot axially aligned within the upper wall and of a length greater than the "T" shaped lock member for receiving the "T" shaped lock member therewithin to enable rotation of the "T" shaped lock member within the space when the "T" shaped lock member is received through the slot.

10. A refuse container caddy apparatus as set forth in claim 9 including a fill plug and cap member received through the first tray and secured to the second support tray in communication with a base cavity formed interiorly of the second tray for selective filling of the base cavity second support tray with a fluid.

* * * * *